United States Patent [19]

Kawabata et al.

[11] Patent Number: 5,024,253

[45] Date of Patent: Jun. 18, 1991

[54] SYSTEM FOR CONTROLLING WARP TAKE UP AND LET OFF RATES

[75] Inventors: Susumu Kawabata; Kazunori Yoshida; Yoshikatsu Kisanuki; Hajime Suzuki; Masao Shiraki, all of Aichi, Japan

[73] Assignees: Kabushiki Kaisha Toyota Chuo Kenkyusho, Aichi; Kabushiki Kaisha Toyoda Jidoshokki, Kariya, both of Japan

[21] Appl. No.: 458,406

[22] Filed: Dec. 28, 1989

[30] Foreign Application Priority Data

Dec. 28, 1988 [JP] Japan ..... 63-334047

[51] Int. Cl.[5] ..... D03D 49/10; D03D 49/20

[52] U.S. Cl. ..... 139/99; 139/110

[58] Field of Search ..... 139/99, 110

[56] References Cited

U.S. PATENT DOCUMENTS 4,619,294 10/1986 Sainen et al. ..... 139/99

4,817,677 4/1989 Deconinck et al. ..... 139/110 X

FOREIGN PATENT DOCUMENTS 61-16382 1/1986 Japan .

62-263347 11/1987 Japan .

3021953 1/1988 Japan ..... 139/99

1-148842 6/1989 Japan .

*Primary Examiner*—Andrew M. Falik

*Attorney, Agent, or Firm*—Oblon, Spivak, McClelland, Maier & Neustadt

[57] ABSTRACT

A take-up rate and a let-off rate in warp feed on a loom are controlled while a displacement (ΔL) of a cloth fell position C is taken into account. The system comprises a cloth fell position compensation circuit (2, 16, 21) which outputs a cloth fell compensation signal ($\Delta\omega_c$) to compenate a displacement (ΔL) of the cloth fell position (C) when a weaving condition such as a target weft density (D*), a target warp tension (T*) or the kinds of weft and warp yarns is changed. The cloth fell compensation signal is added to a basic warp feed rate ($\omega_f$) obtained from D*, so that the displacement motion of the cloth fell is completed in a shorter time. According to this compensation, a weft density of a resultant fabric rapidly coincides with the target weft density.

9 Claims, 12 Drawing Sheets

LM
C
M1
ω1
M2
ω2
4
T
TENSION DEVIATION CALCULATING CIRCUIT
5
T*-T
GAIN COMPENSATOR
6
G1·ω1*
LET-OFF CONTROL CIRCUIT
7
ω2*
LET-OFF MOTOR DRIVING CIRCUIT
9
ω1*
TAKE-UP MOTOR DRIVING CIRCUIT
8
ω1*
TAKE-UP CONTROL CIRCUIT
3
Δωc
CLOTH FELL POSITION COMPENSATING CIRCUIT
2
ω1*
WEAVING CONDITION SETTING DEVICE
1

WARP FEED RATE IN ACCORDANCE WITH WEFT DENSITY CHANGE
TIME LAG

WEFT PITCH IN CONVENTIONAL METHOD
UPPER LIMIT OF MOTOR ROTATION
COMPENSATION SIGNAL
MODIFIED WARP FEED RATE OF THE PRESENT INVENTION

LOWER LIMIT OF MOTOR ROTATION

TIME LAG
WEFT PITCH IN THE PRESENT INVENTION

ANOTHER MODIFIED WARP FEED RATE

M2
18
15 LET-OFF CONTROL CIRCUIT
152
ADDER
151
G2
G2·(T*-T)
ω2*=G1·ω1*+G2·(T*-T)
T*-T
13
132
T
T*
131
12
TENSION DETECTOR
CLOTH FELL POSITION COMPENSATING CIRCUIT 16
14 GAIN COMPENSATOR
143
144
INTEGRATOR
145
G1
G1·ω1*
142
141
17 TAKE-UP CONTROL CIRCUIT
M1
ω1*
S
11
112
111
ADDER
ω1*
Δωc
162
163
SPEED COMMAND VARIATION DETECTING CIRCUIT
161
ωf*·D*·N
10
WEAVING CONDITION SETTING DEVICE

INTERRUPTION PROGRAM
EXECUTED WHEN ZERO PHASE PULSE IS ISSUED

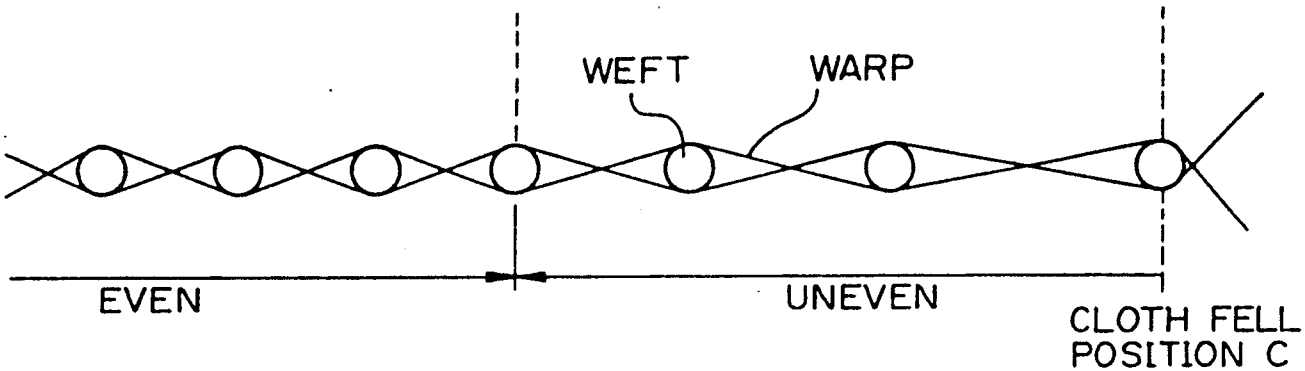
Fig. 10(a) WEFT ARRANGEMENT WHEN LOOM STOPS
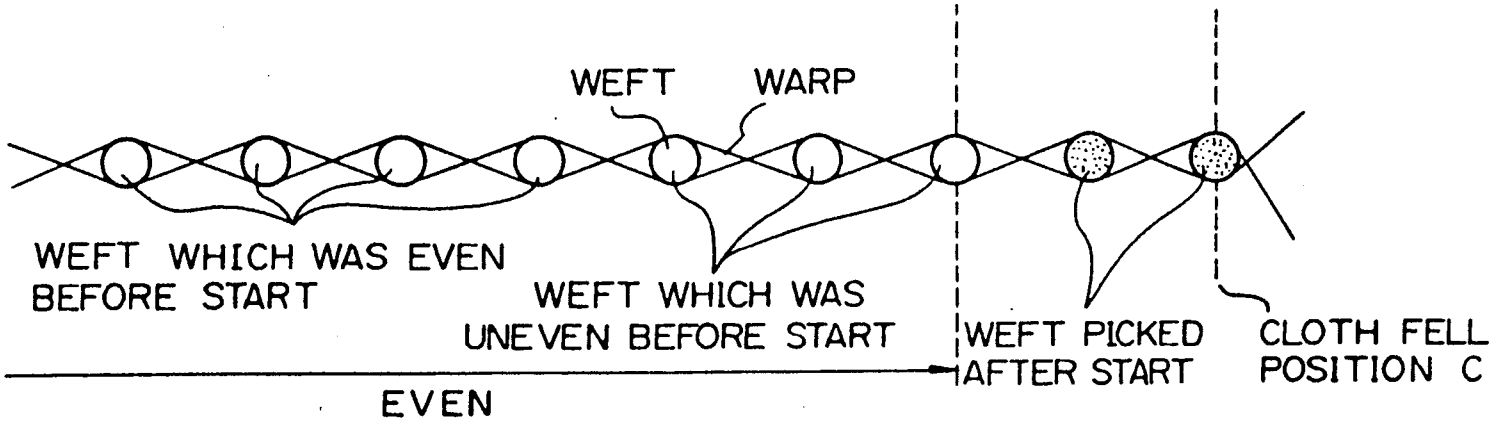
Fig. 10(b) WEFT ARRANGEMENT WHEN LOOM STARTS

SYSTEM FOR CONTROLLING WARP TAKE UP AND LET OFF RATES

BACKGROUND OF THE INVENTION

1. Field of the Invention

The present invention relates to a system for controlling a warp feed in a loom in response to changes of weaving conditions.

2. Description of the Related Art

In the prior art, a weft density of a fabric is adjusted by cooperatively controlling take-up and let-off rates of a warp on a loom in accordance with a target weft density, as disclosed in Japanese Unexamined Patent Publication No. 62-263347. In the above document, the take-up rate and the let-off rate are taken as functions solely of the target weft density, and other weaving conditions are not taken into account. This is because it has been considered in the prior art that the weft density is merely an inverse proportional factor to the take-up or let-off rate of warp feed.

According to experiments conducted by the present inventors, it has been proved that the actual weft density in a fabric portion immediately after a change of the weaving condition has occurred is different from the target weft density. Namely, even if the target weft density is changed in a stepwise manner, the actual density varies gradually, whereby a considerably large area is formed in which the weft density is different from the target value.

This is because a position of a cloth fell, i.e., a boundary line between a warp region in which a weft has not been inserted and a fabric now being formed on a loom, moves by a certain distance until a steady state is reestablished corresponding to the change of the target weft density. Such a displacement of cloth fell position may be caused not only by the change of the target weft density but also by changes of other weaving conditions, such as the kind of weft or warp yarns or a warp tension.

Namely, as shown in FIG. 2(*a*), when a change of the weaving condition occurs, the cloth fell C is displaced from an original position L to a position L′ or L″ shown in chain lines, at which a new steady state of the cloth fell C is reestablished in accordance with a tension balance between warp and fabric in the vicinity of the cloth fell.

The above phenomenon will be explained in more detail with reference to FIG. 2(*b*). Assuming a displacement of the cloth fell position C per weft pick is $\Delta L$, then this value can be equivalent to a displacement rate $\Delta V_c$ of the cloth fell position, because the weft is picked at a constant period. The displacement rate $\Delta V_c$ may have either a positive value or a negative value, in accordance with the direction in which the cloth fell position C is moved. Accordingly, as shown in FIG. 2(*b*), a warp feed rate V is influenced by this $\Delta V_c$ as if the apparent warp feed rate V′ becomes larger or smaller corresponding to the direction in which the cloth fell position C is moved. Note, the $\Delta V_c$ converges to zero as the steady state is reestablished under the new weaving conditions, but the disturbance of the weft density continues while the displacement of the cloth fell position continues. Even if it is desired to change the weft density in a stepwise manner, as illustrated in FIG. 2(*c*), the actual weft density gradually varies in accordance with the displacement of cloth fell position over a fabric length corresponding to about ten through twenty picks until the new cloth fell position is established.

Accordingly, in the prior art, a transition of the weft density cannot be avoided when the weaving condition has changed.

SUMMARY OF THE INVENTION

An object of the present invention is to eliminate the above drawbacks of the prior art.

Another object of the present invention is to provide a system for obtaining a desired weft density in a fabric when a weaving condition, such as a target weft density, kinds of weft and warp yarns, warp tension, or woven structure such as a plain or twill weave, has been changed, by a cooperative optimum control of take-up and let-off rates of warp feed, which take the displacement of the cloth fell position into full account.

The above objects are achieved by a system illustrated in FIG. 1, according to the present invention, for controlling take-up and let-off rates of a warp feed on a loom by taking the displacement of a cloth fell position into account when the weaving condition has changed; comprising a device 1 for setting weaving conditions; a cloth fell position compensation circuit 2 for outputting a cloth fell compensation signal $\Delta\omega_c$ corresponding to a displacement of the cloth fell position caused by the variation of the weaving conditions; a take-up control circuit 3 for outputting a take-up rate control signal $\omega_1^*$ for controlling a rotational rate of a take-up motor for driving a take-up roller of the loom, which signal is modified by the weaving conditions and the cloth fell position compensation signal $\Delta\omega_c$; a tension detector 4 for detecting a warp tension T; an arithmetic circuit 5 for comparing the detected warp tension T with a target warp tension T* and outputting a deviation therebetween (T*−T); a gain compensation circuit 6 for outputting a gain compensation signal $G_1 \cdot \omega_1^*$ obtained by multiplication of the take-up rate control signal $\omega_1^*$ modified by the displacement of the cloth fell position by a gain corresponding to the deviation (T*−T) between the detected warp tension and the target warp tension; and a let-off control circuit 7 for outputting a let-off rate control signal $\omega_2^*$ for controlling a rotational rate of a let-off motor for driving a let-off beam, comprising an adder for adding a signal proportional to the tension deviation (T*−T) to the take-up rate control signal $G_1 \cdot \omega_1^*$ modified by the gain compensation circuit 6.

If a weaving condition such as a target weft density D* is changed through the weaving condition setting device 1, a signal $\omega_f^*$ inversely-proportional to the weft density D* is output therefrom, and the cloth fell position compensating circuit 2 in turn outputs the cloth fell position compensating signal $\Delta\omega_c$ corresponding to the displacement of the cloth fell position. The take-up control circuit 3 outputs the take-up rate control signal $\omega_1^*$ in accordance with the signal $\omega_f^*$ from the weaving condition setting means 1 and the cloth fell position compensation signal $\Delta\omega_c$ from the cloth fell position compensation circuit 2. This signal $\omega_1^*$ is input to a take-up motor driving circuit 8, so that the rotational rate of the take-up motor can be controlled while the displacement of the cloth fell position is taken into account. On the other hand, the tension detector 4 outputs a tension signal T detected thereby, and the arithmetic circuit 5 operates to output the tension deviation signal (T*−T) by a comparison of the detected tension T relative to the target tension T*. The gain compensation circuit 6 outputs the gain compensation signal $G_1 \cdot \omega_1^*$ obtained by the multiplication of the take-up rate control signal $\omega_1^*$ with a gain $G_1$ corresponding to the tension deviation signal $(T^* - T)$. The let-off control circuit 7 adds the tension deviation signal $(T^* - T)$ to the gain compensation signal $G_1 \cdot \omega_1^*$ and outputs the result as the let-off rate control signal $\omega_2^*$ modified by the displacement of the cloth fell position. This signal $\omega_2^*$ is input to a let-off motor driving circuit 9, so that the rotational rate of the let-off motor can be controlled while the displacement of the cloth fell position is taken into account.

As stated above, according to the system of the present invention, since the rotational rates of both the take-up and let-off motors are cooperatively controlled so that the cloth fell displacement can be rapidly completed, the transition state of a weft density does not last for a long period as in the prior art, and therefore, an undesirable gradual change of a weft density on the woven fabric, having often observed in the prior art, can be eliminated.

DESCRIPTION OF THE DRAWINGS

The present invention will be described in more detail with reference to the attached drawings: wherein

FIG. 2(*b*) is a diagram showing the variation of an apparent warp feed rate in accordance with the displacement of a cloth fell position;

FIG. 2(*c*) is a graph showing the displacement of a cloth fell position when a weft density changes in a stepwise manner;

FIG. 3(*b*) is a graph showing a relationship similar to FIG. 3(*a*), using a warp tension as a parameter;

FIG. 4(*b*) is an example of a signal pattern shown in FIG. 4(*a*) modified by a cloth fell position compensating signal;

FIG. 5(*b*) is a time dependent change of a weft pitch in the prior art obtained by the control using the signal of FIG. 5(*a*);

FIG. 5(*c*) is an example of a signal pattern similar to that shown in FIG. 5(*a*) but modified by a cloth fell position compensation signal in accordance with the present invention;

FIG. 5(*d*) is a time dependent change of a weft pitch produced by the signal shown in FIG. 5(*c*);

FIG. 5(*e*) is a further example of a signal pattern similar to FIG. 5(*a*) modified by a cloth fell position compensating signal in accordance with the present invention;

FIG. 10 is a diagram of a weft arrangement when a loom is stationary; and,

DESCRIPTION OF THE PREFERRED EMBODIMENTS

A principle of a cloth fell position compensation circuit according to the present invention will be described with reference to a case in which the target weft density is changed.

Figure 2A:
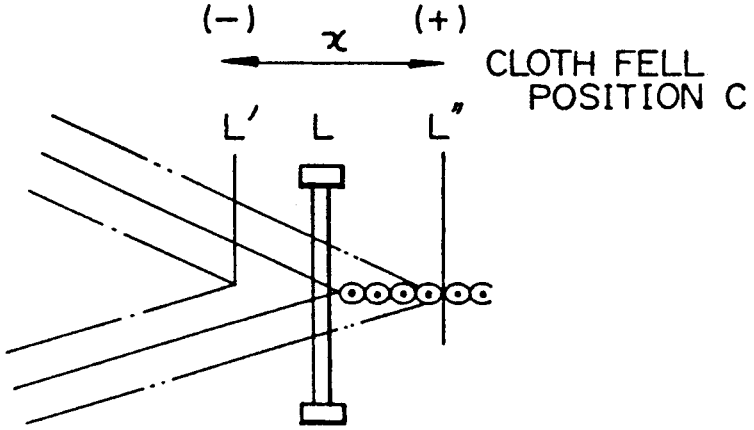
FIG. 2(*a*) is a diagram of variations of a cloth fell position.
Figure 2B:
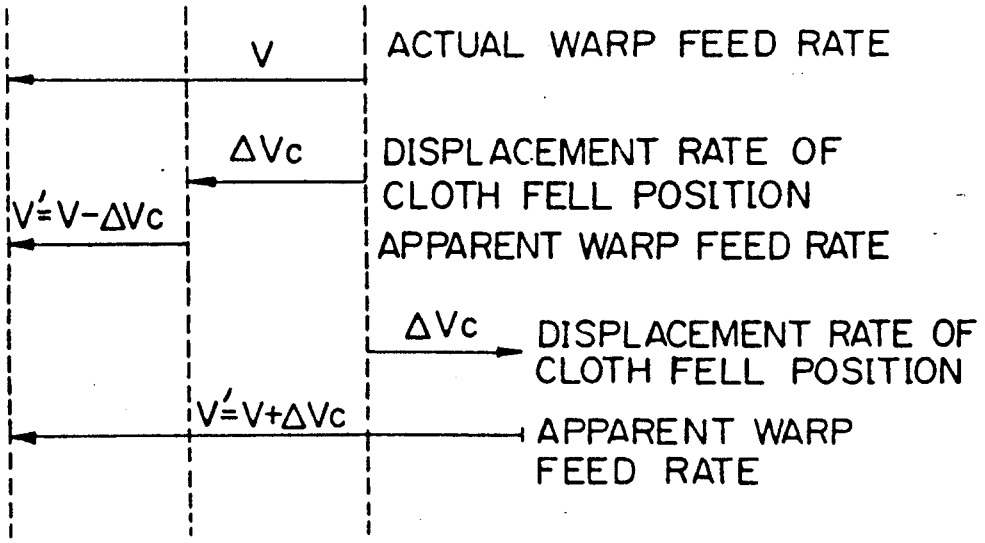
Figure 2C:
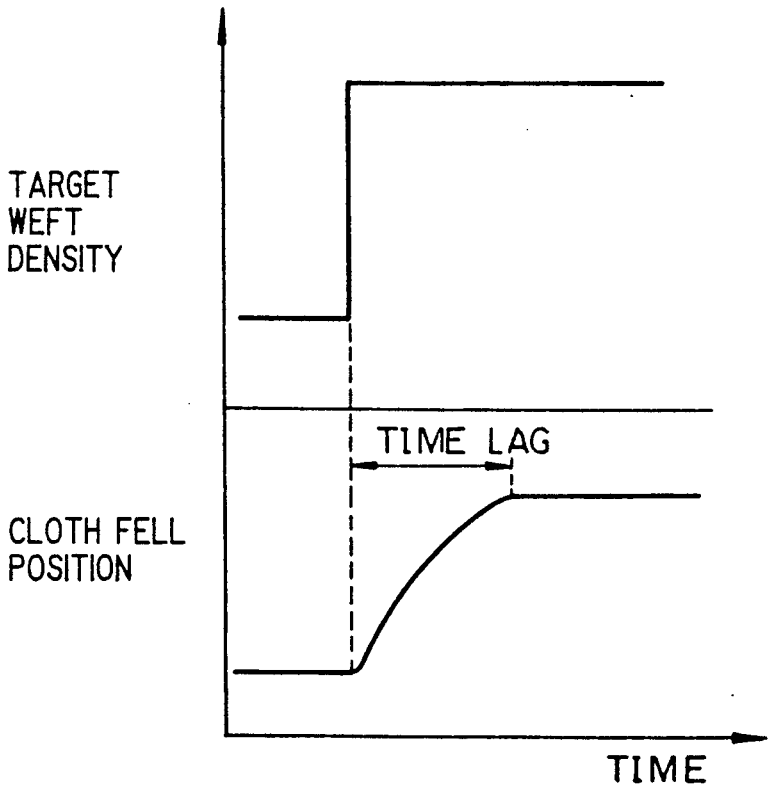

As stated hereinbefore, even when a weaving condition, such as a weft density, is stepwisely changed as shown in FIG. 2(*c*), the cloth fell position cannot be instantly displaced to a new steady position in response thereto, but is gradually moved to this new position, and wefts picked during this gradual displacement of the cloth fell position cause a density unevenness in a resultant fabric. Accordingly, the cloth fell position compensation circuit of the present invention is intended to obtain a signal to shorten the period of the displacement of the cloth fell position.

When the target density is changed, the cloth fell is displaced in synchronization with the weft picking, although the displacement per pick is very small. According to an experiment conducted by the present inventors, a reestablished cloth fell position is represented as a linear function of a weft density, although the inclination varies with the yarn thickness, as shown in a graph of FIG. 3(*a*), and with the warp tension as shown in a graph of FIG. 3(*b*).

The cloth fell position compensation circuit controls at least either one of a compensation value $\Delta\omega_c$ for modifying a basic warp feed rate with reference to a displacement $\Delta L$ of cloth fell position varying in accordance with the change of the target weft density, or a time duration $\Delta t$ during which $\Delta\omega_c$ is output. A magnitude of $\Delta\omega_c$ and the time duration $\Delta t$ must be selected with reference to a fabric quality, motor characteristic, etc., and for this purpose, a command for changing a weaving condition, such as a weft density, may be differentiated, relative to a passing of time, in a real time manner and the obtained data used for controlling the magnitude or the $\Delta t$ of the $\Delta\omega_c$. Alternatively, many pairs of $\Delta\omega_c$ and times $\Delta t$ may be prepared by preliminary experiments corresponding to the changes of the respective weaving conditions, and an optimum pair selected when a change of the weaving condition occurs. According to a feed-forward control based on such a compensation signal, the time necessary for the displacement of the cloth fell position accompanied by the change of the weaving condition can be shortened, whereby the disturbance of the weft density is minimized.

Figure 4A:
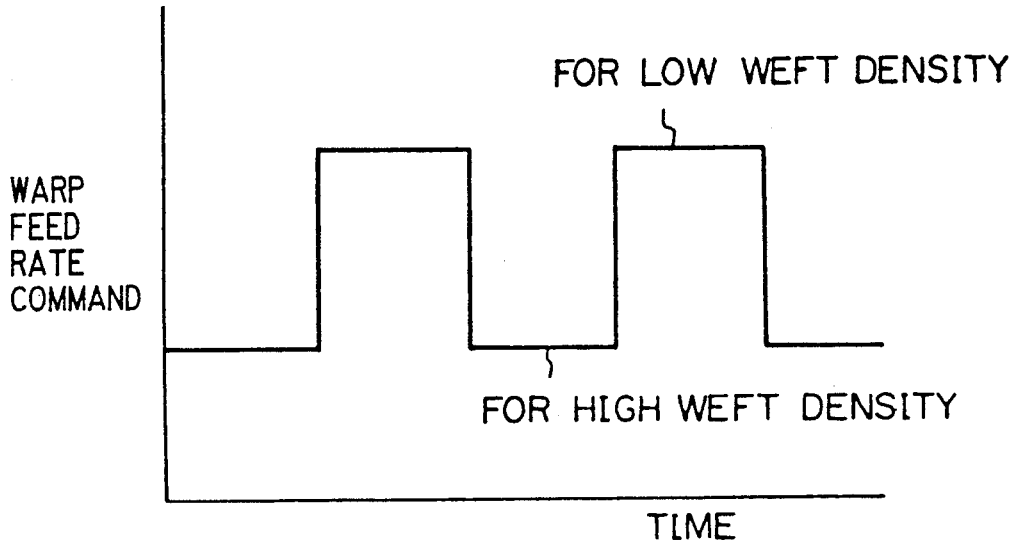
FIG. 4(*a*) is an example of a stepwise signal pattern for a warp feed rate when a weft density is to be changed between two levels.
Figure 4B:
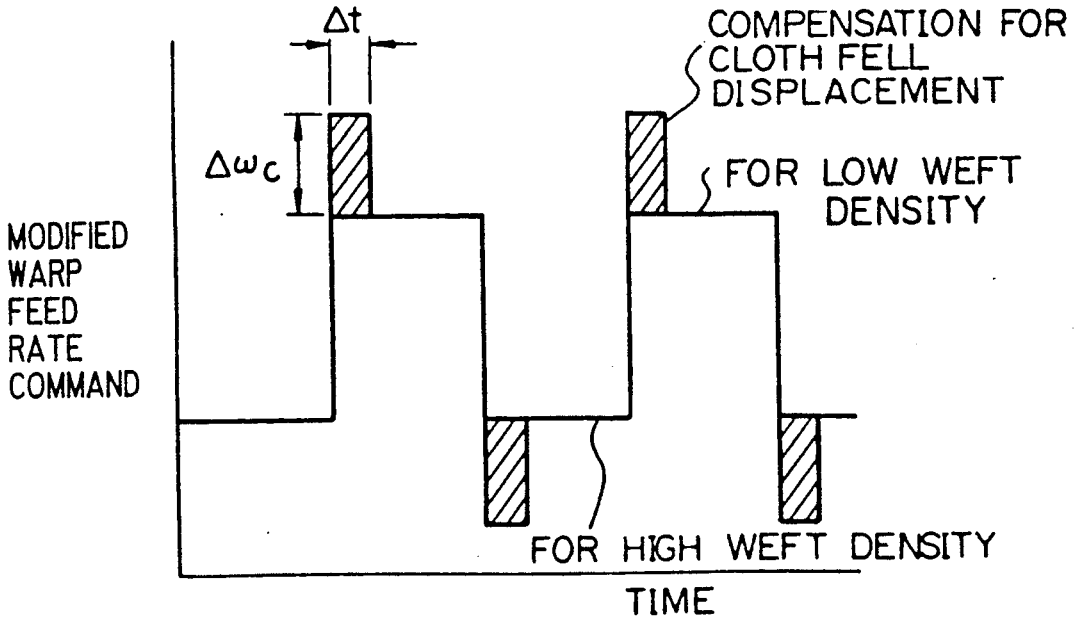

The cloth fell position compensation circuit according to the present invention outputs a compensation value $\omega_c$, for a take-up rate, corresponding to a displacement $\Delta L$ of the cloth fell position accompanied by the change of a target weft density D* when a command signal shown in FIG. 4(*a*) is received from the weaving condition setting device. The magnitude of $\Delta\omega_c$ is decided by taking a fabric quality and a motor characteristic into account. That is, if a steep change in the resultant weft density is necessary, the compensation period $\Delta t$ shown in FIG. 4(*b*) should be short and a magnitude of $\Delta\omega_c$ should be large. Hatched areas in FIG. 4(*b*) represent a total size of the cloth fell position compensation signal, which is combined in a take-up control circuit with a basic warp feed rate command output from the weaving condition setting device. This modified speed command is illustrated in FIG. 4(*b*). If a motor to be controlled has a poor responsitivity and cannot follow this pulsed signal, the magnitude of $\Delta\omega_c$ value should be made smaller and the $\Delta t$ made longer. In this case, the resultant weft density D does not change so steeply. In any case, the magnitude of $\Delta\omega_c$ and the $\Delta t$ are selected so that the following equation is satisfied.

$$\Delta L = \int_0^{\Delta t} \Delta\omega_c dt$$

wherein $\Delta L$ is a displacement of a cloth fell position.

Note, these values may be obtained without regard to the above equation, but by taking the fabric quality into account.

Figures 5A, 5B, 5C, 5D, 5E:
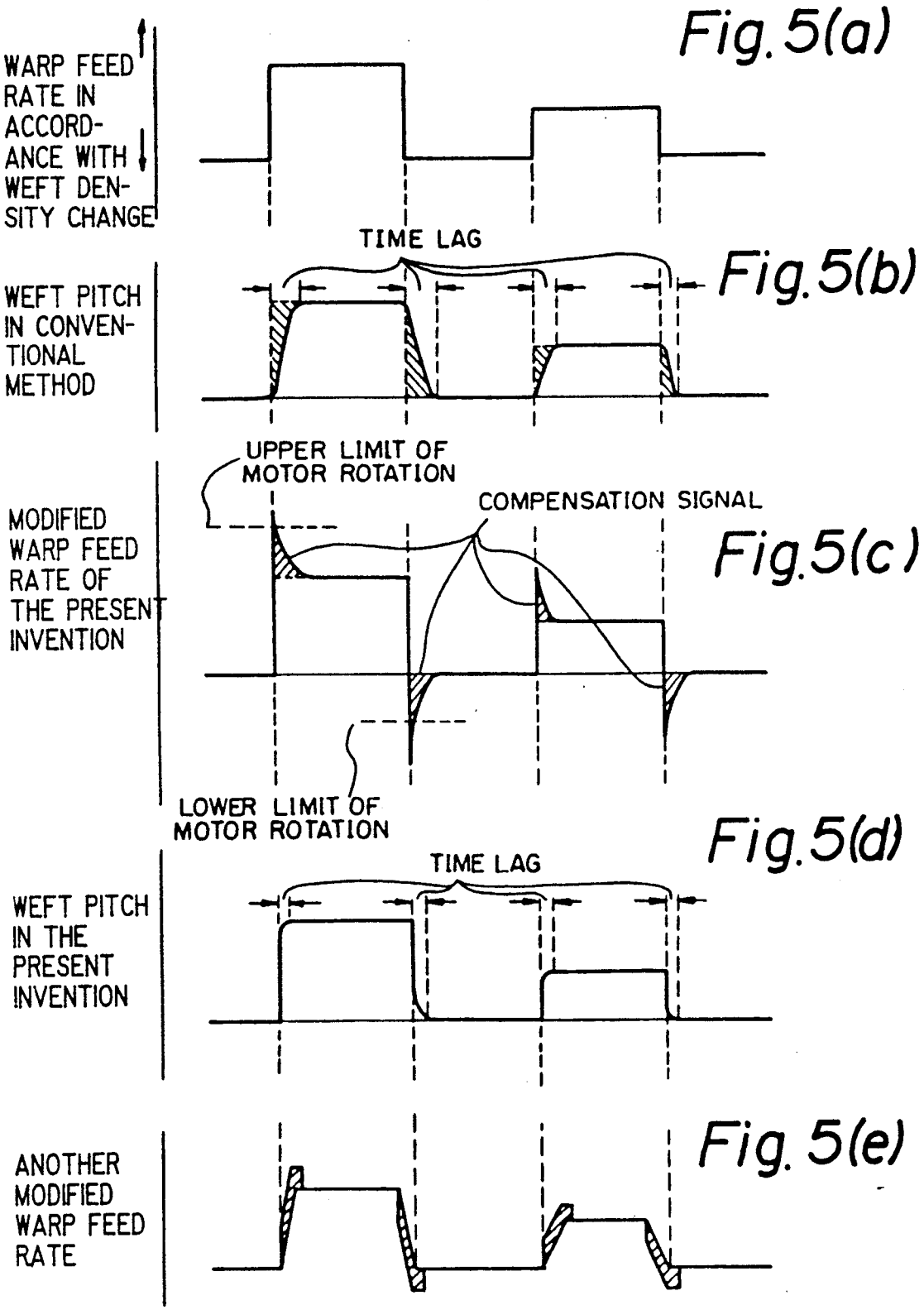
FIG. 5(*a*) is another example of a stepwise signal pattern for a warp feed rate when a weft density is to be changed between three levels.

In the conventional method, in which the warp feed is controlled merely by a basic warp feed rate command defined as a function inversely-proportional to a target weft density, as shown in FIG. 5(*a*), there is a considerable time lag until the actual weft density coincides with the target density, when the target weft density is changed, as shown in FIG. 5(*b*).

Conversely, if a compensation signal proportional to a differential value of the basic warp feed rate command of FIG. 5(*a*) is added to the basic warp feed rate command by the cloth fell position compensating circuit according to the present invention, a modified warp feed rate command shown in FIG. 5(*c*) is obtained, whereby the time lag of the actual weft density relative to the target weft density is considerably shortened, as shown in FIG. 5(*d*). Namely, the time lag in the conventional method hatched in FIG. 5(*b*) is preliminarily added as a compensation signal hatched in FIG. 5(*c*) to the basic feed rate command, so that the feed-forward control is conducted. If a motor to be controlled has upper and lower rotational limits, the compensation signal also should have upper and lower limits corresponding thereto. In such a case, a time $\Delta t$ for outputting the compensation signal is preferably prolonged accordingly.

If the basic command has a trapezoidal form as shown in FIG. 5(*e*), the compensation signal is added as shown by the hatching in the drawing, whereby a more improved control of the weft density can be achieved.

The cloth fell position compensation according to the present invention can be conducted in various ways. For example, (1) a density change command is processed in a real time manner and the obtained data is added to a basic speed command for the rotation of a motor output by a weaving condition setting device, and (2) a possible density change command is preliminarily processed and the obtained data is stored in a memory, which data is temporarily read therefrom when needed and added to a basic warp feed rate command for the rotation of a motor output by a weaving condition setting device.

Various circuits may be used when practicing the first method (1), but preferably a cloth fell position compensation circuit comprising a differentiating circuit for differentiating a command for the change of a weft density and an amplifier for multiplying the differentiated signal by a certain constant is used. These circuits may be formed by analog or digital arithmetic circuit. The advantages of this method reside in the simplicity of the data processing, but the data must be processed in a very short period because a real time processing is necessary. Therefore, this method is not suitable when a precise control is required.

The second method (2) requires the use of a microcomputer in which process programs and data tables, prepared by the preparatory experiments, are stored for obtaining a cloth fell position compensation. The compensation signal is obtained by sequentially referring to these tables and programs. According to this method, a precise control is possible even when a plurality of factors of the weaving conditions are simultaneously changed, such as a weft density and a thickness of a weft yarn, or a weft density and a weaving structure.

FIRST EMBODIMENT

Figure 6:
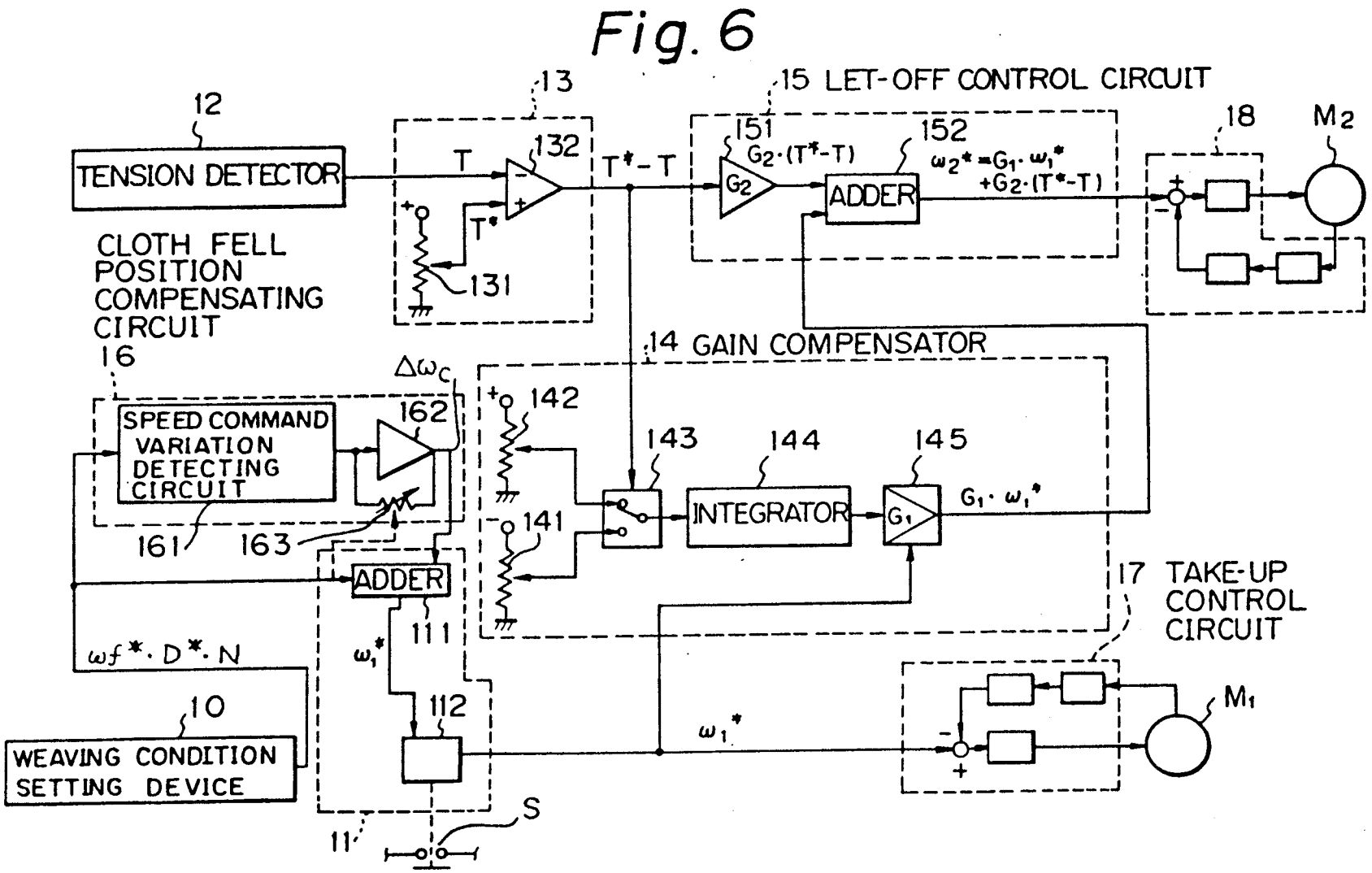
FIG. 6 is a block diagram of a first embodiment of a system according to the present invention.

A first embodiment of a system, according to the present invention, as shown in FIG. 6, is intended to control the change of a target weft density D* at two levels during the weaving operation.

A weaving condition setting device 10 outputs a weft density command D* corresponding to a target weft density pattern on a fabric and a rotational rate N (rpm) for a loom motor. In addition to these commands, the device 10 also outputs a basic take-up rate command $\omega_f^*$ in accordance with equation (1), with reference to the weft density D (/inch);

$$\omega_f^* = [(25.4/D)/D_f]\cdot(N/60)\ (rad/sec) \quad (1)$$

for controlling a rotational rate $\omega_1$ of a take-up motor $M_1$. In this connection, $D_f$ is a constant corresponding to a diameter of a take-up roller and a reduction ratio thereof.

The cloth fell compensation circuit 16 consists of a take-up rate variation detecting circuit 161 and a variable gain amplifier 162. The take-up rate variation detecting circuit 161 comprises a differentiator for detecting a time dependent variation of the basic take-up rate command $\omega_f^*$ output from the weaving condition setting device 10, and outputs, for a unit of time, a reference signal informing the variable gain amplifier 162 whether or not such a variation has occurred. The variable gain amplifier 162 amplifies the reference signal and outputs a cloth fell compensation signal $\Delta\omega_c$ modifying the basic take-up rate command $\omega_f^*$.

According to this embodiment, a weft density is changed between two levels, i.e., from a higher level to a lower level or vice versa. If a more precise change of the weft density is necessary, a gain of the variable gain amplifier 162 may be varied in accordance with a value of the basic take-up rate command $\omega_f^*$, as illustrated by a dotted arrow in FIG. 6.

The take-up control circuit 11 comprises an adder 111 for adding the basic take-up rate command $\omega_f^*$ output from the weaving condition setting device 10 to the cloth fell compensation signal $\Delta\omega_c$, and outputs the resultant value as a modified command $\omega_1^*$.

The tension detector 12 detects a warp tension T by a load cell or the like and outputs a corresponding signal. The signal is input to a tension deviation calculating circuit 13.

The take-up control circuit 11 further comprises a switch 112 which is either "on" or "off" in association with a starting switch S for a loom motor LM, and in the "on" position, transmits the modified take-up rate $\omega_1$* to a take-up motor driving circuit 17 for driving the take-up motor $M_1$. The $\omega_1$* is also output to a gain compensator 14 connected to the circuit 11.

The tension deviation calculating circuit 13 comprises a variable resistor 131 for setting a target warp tension T* as an electric signal, and a difference amplifier 132 for obtaining a difference between the signal corresponding to the detected warp tension T output from the tension detector 12 and the signal corresponding to the target warp tension T* set by the variable resistor 131, and outputs this difference to a let-off control circuit 15 and the gain compensator 14.

The gain compensator 14 comprises a pair of variable resistors 141 and 142 for setting predetermined positive and negative direct-current voltage values, respectively, a sign selector 143 for selecting either of the variable resistor 141 or 142 in accordance with a polarity sign of the electric signal output from the difference amplifier 132, and connecting the selected resistor to a integrator 144 which amplifies the preset voltage output from the resistor 141 or 142. More specifically, if the signal from the difference amplifier 132 has a positive sign, the positive voltage resistor 142 is selected, and if the signal has a negative sign, the negative voltage resistor 141 is selected. The gain compensator 14 further comprises an integrator 144 for integrating the selected preset voltage output through the sign selector 143, and outputs the integral value to a variable gain amplifier 145 which amplifies the take-up rate command $\omega_1$* from the take-up control circuit 11 with a suitable gain determined in accordance with this integral value; i.e., if this value is positive, a smaller gain is selected, and if this value is negative, a larger gain is selected. Finally, the obtained signal is transmitted to a let-off control circuit 15.

The let-off control circuit 15 comprises an amplifier 151 and an adder 152. The amplifier 151 proportionally amplifies the electric signal from the tension deviation determining circuit 13 and transmits the result to the adder 152. The adder 152 adds the signal output from the amplifier 151 to the take-up rate command $\omega_1$* output from the gain compensation circuit 14, and transmits the resultant value $\omega_2$*, as a let-off rate command, to a let-off motor driving circuit 18.

The take-up and let-off motor driving circuits 17, 18 carry out a feedback control of a take-up motor $M_1$ and a let-off motor $M_2$ in accordance with the take-up and let-off rate commands $\omega_1$* and $\omega_2$*, while carrying out a feed-forward control for compensating a displacement of a cloth fell position.

Prior to starting this system, the operator sets the weaving conditions, such as a target weft density D* or a rotational speed N of a loom, in the weaving condition setting device 10, and the weaving condition setting device 10 then outputs a basic signal $\omega_f$* based on the equation (1).

By taking the weaving conditions into account, the operator sets a target warp tension T* in the tension deviation calculating circuit 13 through the variable resistor 131.

Figure 3A:
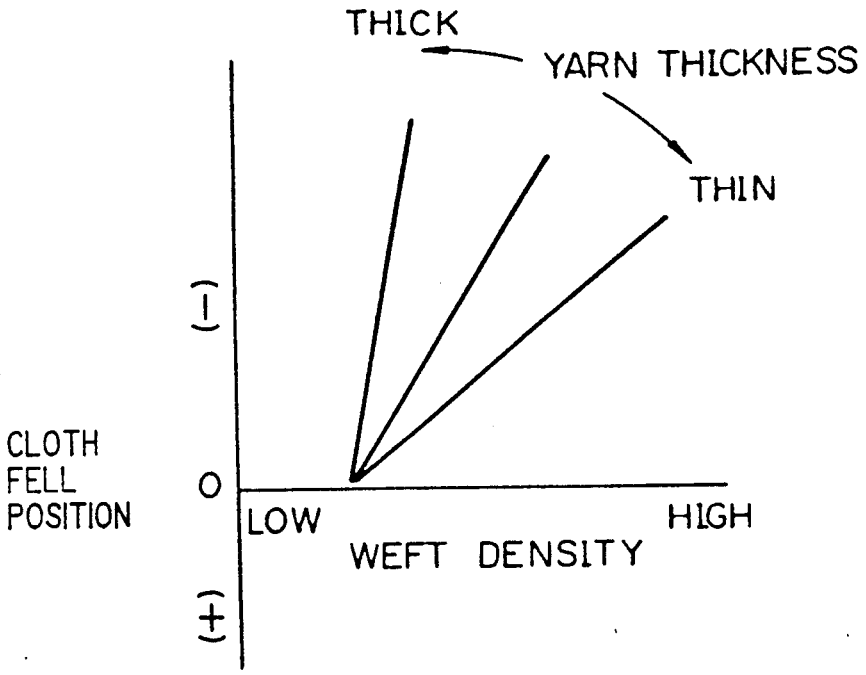
FIG. 3(*a*) is a graph showing a relationship between a weft density and a cloth fell position, using a thickness of a weft yarn as a parameter.
Figure 3B:
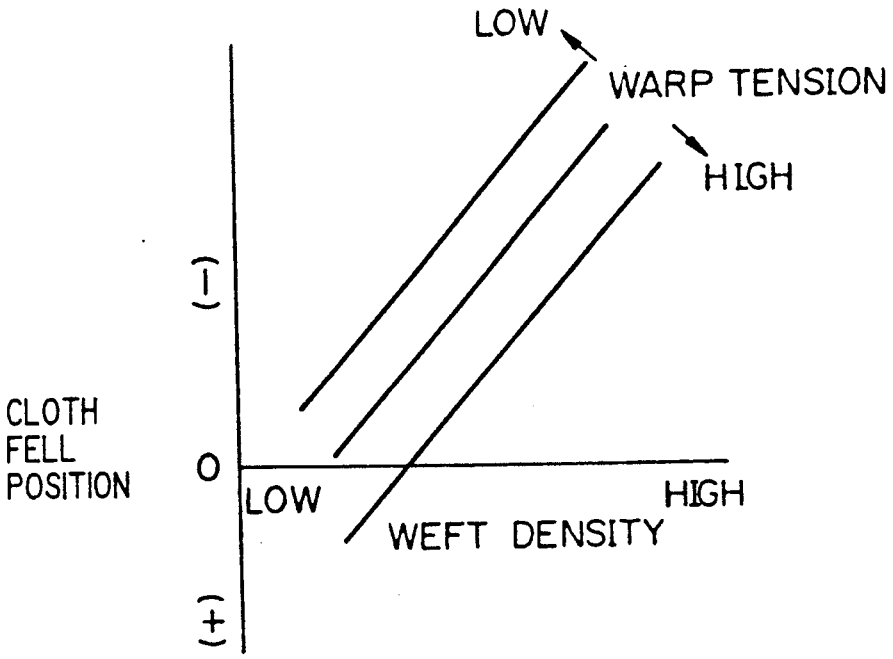

Further, from a preliminarily obtained relationship between the weaving condition and the cloth fell position as shown in FIGS. 3(*a*) and 3(*b*), a gain of the amplifier 162 is determined by the variable resistor 163 in the cloth fell position compensation circuit 16, and a magnitude of the cloth fell compensation signal $\Delta\omega_c$ is determined by this gain of the amplifier 162. A unit of time during which the reference signal is delivered from the take-up rate variation detecting circuit 161 corresponds to $\Delta t$ described before. Also, as stated before, the following relationship exists among the displacement $\Delta L$ of the cloth fell position to be compensated, $\Delta\omega_c$ and $\Delta t$;

$$\Delta L = \int_0^{\Delta t} \Delta\omega_c dt$$

According to this embodiment, $\Delta t$ is always constant, and therefore, a large magnitude $\Delta\omega_c$ is selected when the $\Delta L$ is large, by setting a large gain value in the amplifier 162, and a small magnitude $\Delta\omega_c$ is selected when the $\Delta L$ is small, by setting a small gain value in the amplifier 162.

When the operator turns on a starting switch S for the loom motor LM, the switch 112 in the take-up control circuit 11 is made "on" in association therewith. Then the take-up rate command $\omega_1$* is delivered to the take-up motor driving circuit 17, the $\omega_1$* being formed by adding the basic take-up rate command $\omega_f$* for the take-up motor $M_1$ output from the weaving condition setting device 10 to the cloth fell position compensating signal $\Delta\omega_c$ output from the cloth fell position compensating circuit 16, so that the weaving operation is carried out while the rotation of the take-up motor $M_1$ is controlled by the take-up rate command $\omega_1$*.

In the let-off control circuit 15, an electric signal representing a tension deviation (T*−T), corresponding to the difference between the target warp tension T* set in the variable resistor 131 and the actual warp tension T detected by the tension detector 12 is proportionally amplified by a gain $G_2$ in the amplifier 151. This signal is added to the result delivered from the gain compensator 14, obtained by the multiplication of the variable gain $G_1$ determined by the polarity sign of the tension deviation (T*−T) with the take-up rate command $\omega_1$* output from the take-up control circuit 11, and the resultant signal is delivered to the let-off motor driving circuit 18 as a let-off rate command $\omega_2$*. The rotational rate of the let-off motor $M_2$ is controlled to coincide with the $\omega_2$*. If the tension deviation (T*−T) is positive, i.e., the detected warp tension is larger than the target tension T* or the warp is in a slack condition, the smaller $G_1$ is selected so that the rotational rate $\omega_2$ for the let-off motor is smaller than the rotational rate $\omega_1$ of the take-up motor. Conversely, if the tension deviation (T*−T) is negative, i.e., the detected warp tension is smaller than the target tension T* or the warp is in a tense condition, the larger $G_1$ is selected so that the rotational rate $\omega_2$ for the let-off motor $M_2$ is larger than the rotational rate $\omega_1$ for the take-up motor $M_1$. When the tension deviation has been eliminated as a result of the control, the take-up rate $\omega_1$ and the let-off rate $\omega_2$ coincide with each other. Strictly speaking, $\omega_1$ is smaller than $\omega_2$ due to a crimp shrinkage of warp. As this crimp shrinkage, however, is negligibly samll, $\omega_1$ is substantially equal to $\omega_2$.

When this system is disturbed, for example, when the diameter of a warp beam is reduced with the progress of the weaving operation or when the friction of a warp path is varied, this system also controls the let-off rate and the take-up rate so as to coincide with each other.

According to the repetition of the above control of the take-up and let-off rates of the warp, a fabric with the desired weft density can be obtained.

When the target weft density is changed, the cloth fell position C is displaced, as shown in FIG. 2. This displacement of the cloth fell position causes a disturbance of an apparent warp feed rate, due to a displacement rate $\Delta\omega_c$, and therefore, the weft density D is in error while the displacement of the cloth fell position lasts. According to this embodiment, however, the basic take-up rate command $\omega_f^*$ corresponding to the target density D* is modified with reference to the $\Delta\omega_c$ value, so that the displacement of the cloth fell position is compensated.

The effect of the first embodiment of the present invention is as follows:

Since the increment or decrement of the take-up and let-off rates of warp feed is adjusted to coincide with the displacement of the cloth fell position $\Delta L$ when the target weft density D* has changed, the time lag of the resultant weft density D can be shortened.

The cloth fell compensating circuit 16 according to the first embodiment, has a simple structure, and can be easily introduced into the existing weft density control system without a great modification thereof.

SECOND EMBODIMENT

Figure 7:
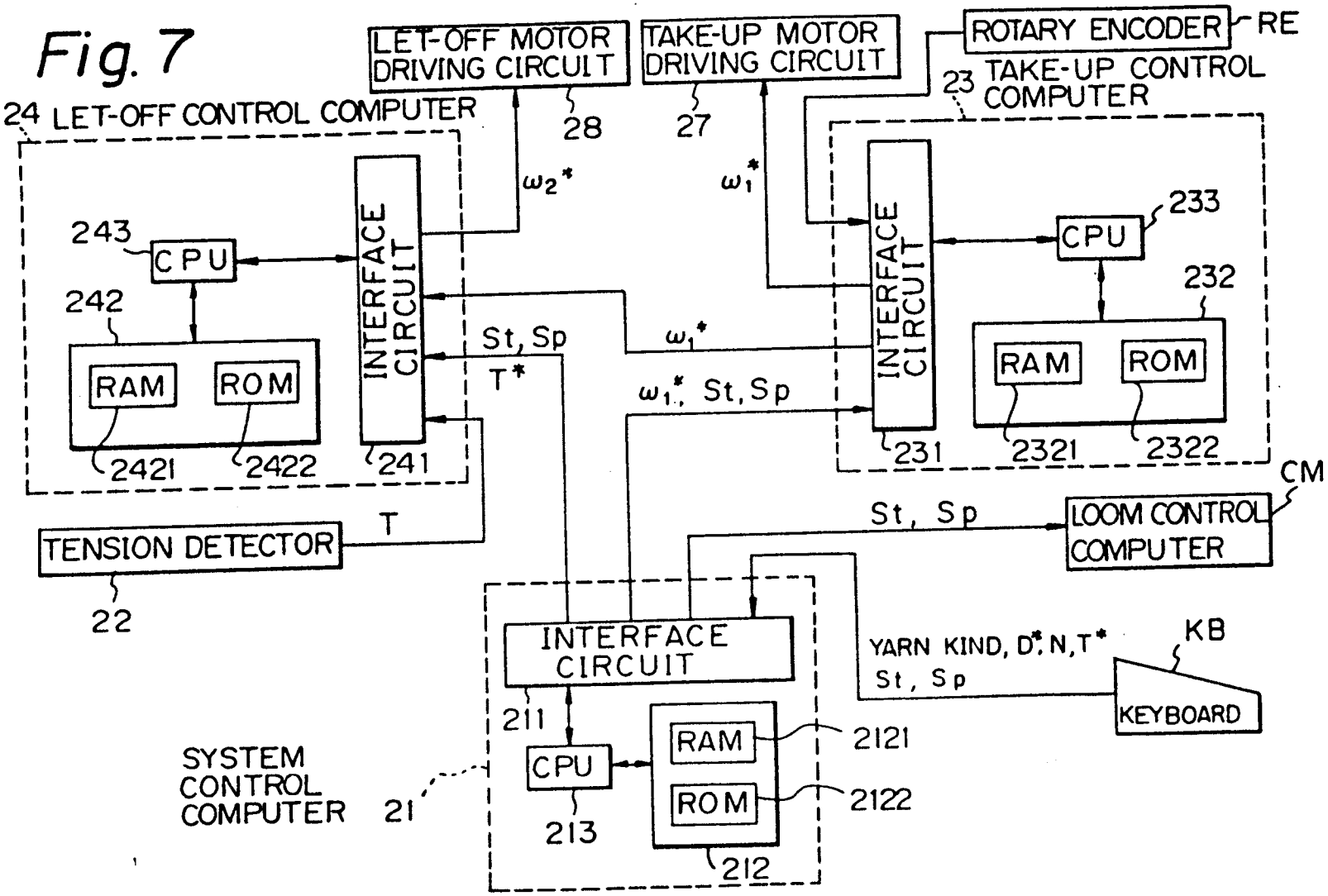
FIG. 7 is a block diagram of a second embodiment of a system according to the present invention.

FIG. 7 is a block diagram illustrating a structure of a system of a second embodiment according to the present invention.

In this embodiment, the relationship between a loom LM and the warp take-up and left-off motor driving devices is the same as that of the first embodiment, and thus only the difference between the two embodiments will be explained hereinafter.

In FIG. 7, the warp feed rate control system according to the second embodiment comprises a keyboard KB for setting the weaving conditions, a tension detector 22 for detecting a warp tension T, a system control computer 21, a take-up control computer 23, and a let-off control computer 24; the respective computers being provided with an interface circuit, a microprocessor (referred to as CPU hereinafter), and a memory.

The system control computer 21 supervises the entire warp feed rate control system and takes in, through the interface circuit 211, the weaving conditions such as a weft density D*, a rotational rate N of the loom, a target warp tension T*, kinds of weft and warp yarns, and a start command St or a stop command Sp input from the keyboard KB.

Figure 8:
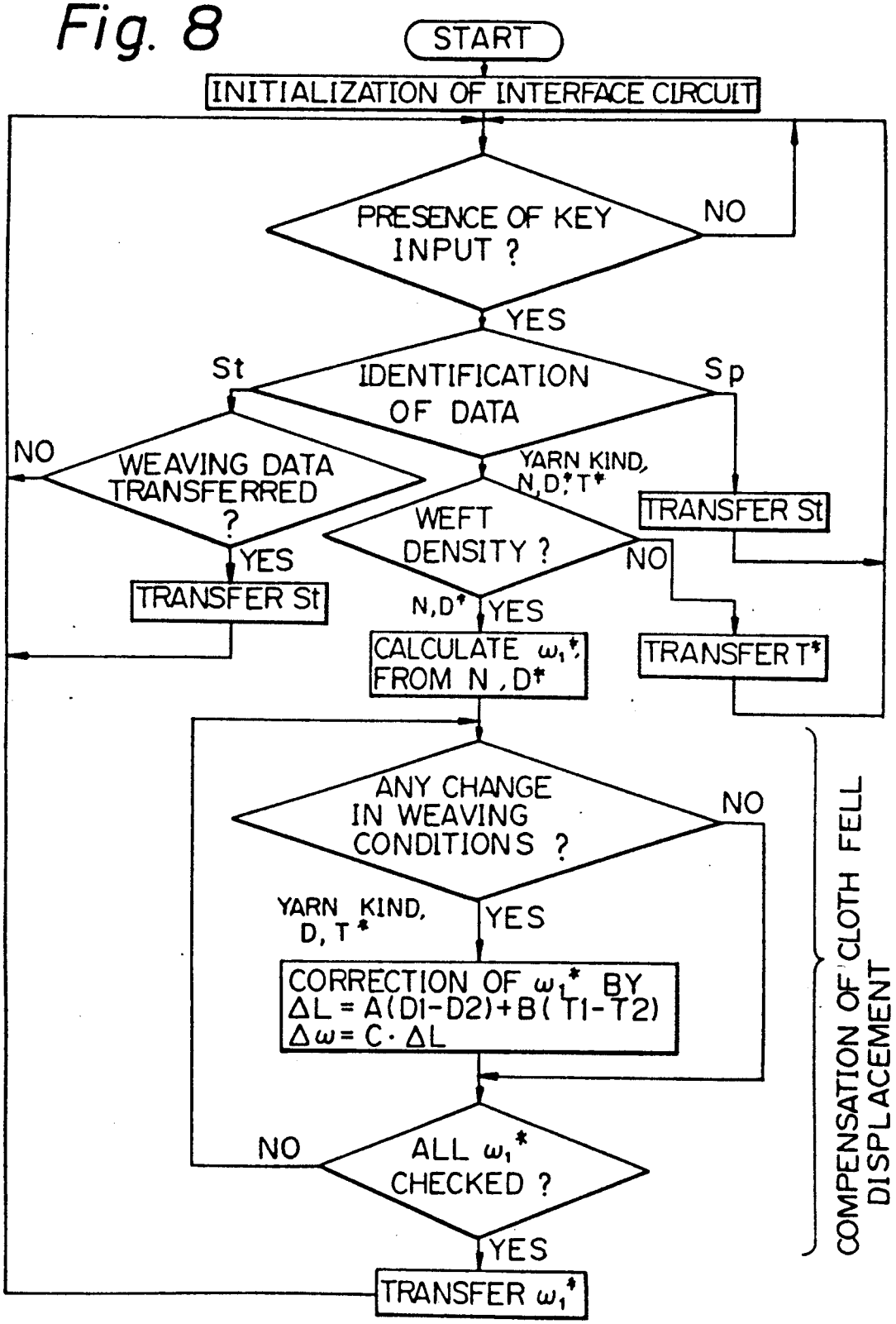
FIG. 8 is a flow chart illustrating the operation of a system control computer.

The system control computer 21 also outputs, through an interface circuit 211, a basic take-up rate command $\omega_f^*$ to the take-up control computer 23; and the start and stop commands St, Sp to a loom control computer CM, the take-up control computer 23, and the let-off control computer 24. The memory 212 consists of a RAM 2121 and ROM 2122. The RAM 2121 stores data related to the weaving conditions input from the interface circuit 211 and data to be processed in the CPU 213. A system control program based on a preset sequence is written, in the ROM 2122, by which the CPU 213 executes sequential processes. An example of such a program is illustrated in FIG. 8.

The system control computer 21 determines a command $\omega_1^*$ for a take-up motor $M_1$ from the target weft density D* and the rotational rate N of the loom in accordance with equation (1). The $\omega_f^*$ is a basic warp feed rate command for obtaining a fabric with the desired weft density D*.

The system control computer 21 sequentially checks whether or not the weaving condition, such as a weft density D*, kinds of weft and warp yarns or a target warp tension T* is to be changed. The object of this check is to obtain information on whether or not a displacement of the cloth fell position will occur. If the check shows that the weaving condition has changed, the basic warp feed rate command $\omega_f^*$ is modified by a value $\Delta\omega$ obtained from the following equation (2);

$$\Delta L = A\cdot(D1 - D2) + B\cdot(T1 - T2)$$

$$\Delta\omega = K\cdot\Delta L \qquad (2)$$

This equation is a linear approximation of the relationship among the weft density D, warp tension T and the cloth fell position C illustrated in FIGS. 3(*a*) and 3(*b*), and coefficients A, B in the above equation have been preliminarily determined from the inclination of a curve illustrating the above relationship. D1, D2 are old and new target weft densities, respectively, and T1, T2 are old and new target warp tensions, respectively.

Accordingly, if the target weft density or the target warp tension is changed during the weaving operation, the displacement of the cloth fell position C is forecast by the equation (2), and thus is compensated by the control system. The $\Delta\omega$ value in the equation (2) corresponds to a compensation signal, and the magnitude thereof can be adjusted by a value of K.

The displacement $\Delta L$ of the cloth fell position is expressed as follows, by a compensation value $\Delta\omega_c$ and a compensation period $\Delta t$:

$$\Delta L = \int_0^{\Delta t} \Delta\omega_c dt$$

In the second embodiment, $\Delta t$ is equivalent to the number of weft picks, because the weft is inserted at a constant period and the take-up rate command $\omega_1^*$ is changed in synchronization with the weft pick, as stated later. The coefficients A, B should be varied when the kind of weft and warp yarns or a warp tension T is changed to suit newly set weaving conditions. It can be considered that the total influence on the displacement of the cloth fell position due to the change of the weaving conditions is a mere addition of the respective changes of the individual weaving conditions, and thus the displacements due to the change of the individual weaving conditions are summed up to produce a total displacement as represented in equation (2).

In the above example, the cloth fell position compensation value $\Delta\omega_c$ is obtained by the equation (2). This value, however, may be obtained by a data table stored in the memory. Alternatively, this value may be obtained by an assumption of the displacement of the cloth fell position from the detectable changes of the take-up and let-off rates $\omega_1$, $\omega_2$ and/or from the detectable change of a warp tension T during the weaving operation.

One example of a pattern of a take-up rate $\omega_1^*$ thus obtained is shown in FIG. 4(*b*) relative to the passing of time, i.e., relative to the number of weft picks in this embodiment.

The $\omega_1$* is stored in the RAM 2121 of the memory 212, and simultaneously, transmitted to the take-up control computer 23 and is stored in the RAM 2321.

Figure 1:
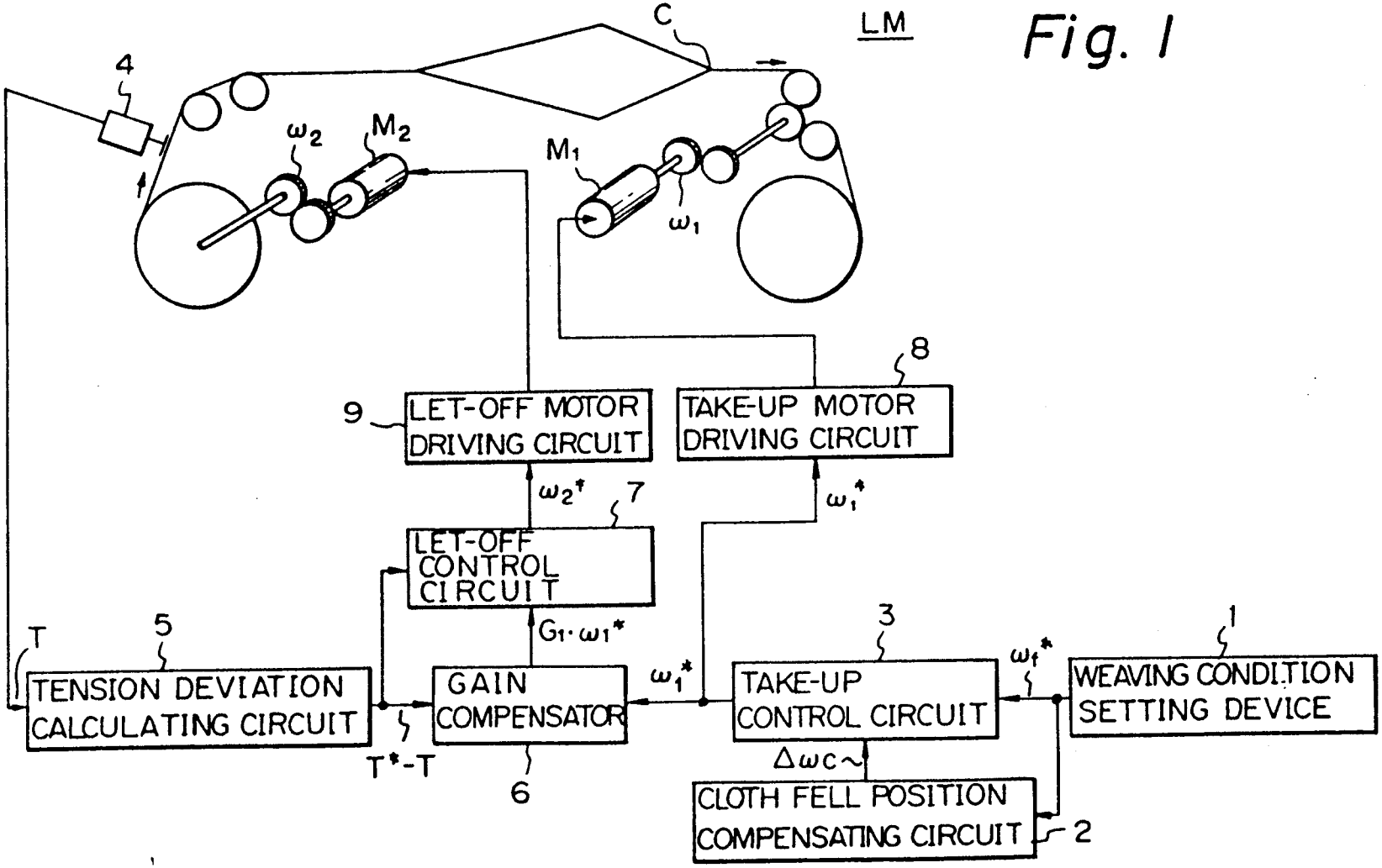
FIG. 1 is a diagram of a warp feed control system according to the present invention, with respect to an associated loom.

The take-up control computer 23 corresponds to the take-up control circuit 3 shown in FIG. 1. The interface circuit 231 takes in the take-up rate command $\omega_1$* for the take-up motor $M_1$, the start command St and the stop command Sp from the system control computer 21, and a zero phase rectangular pulse output by a rotary encoder RE fixed on a loom crank shaft; this pulse being output at each rotation of the loom crank shaft.

The interface circuit 231 outputs the take-up rate command $\omega_1$* for the take-up motor $M_1$ to the take-up motor driving circuit 7 and the let-off control computer 24.

Figure 9A:
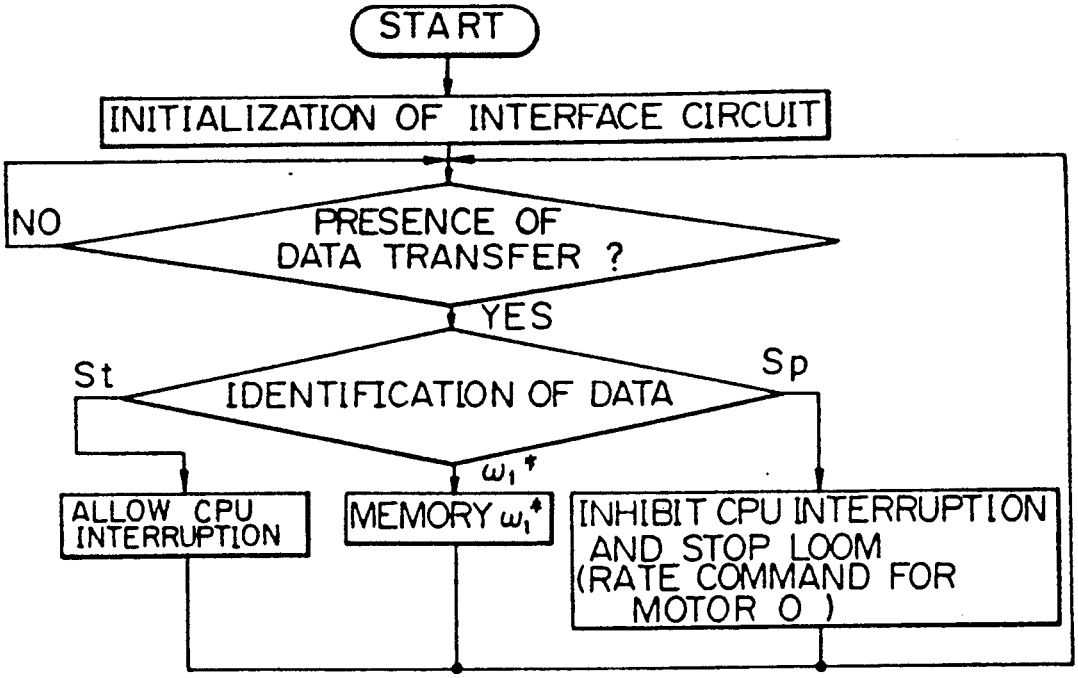
FIG. 9(*a*) and 9(*b*) are flow charts illustrating the operation of a take-up control computer.
Figure 9B:
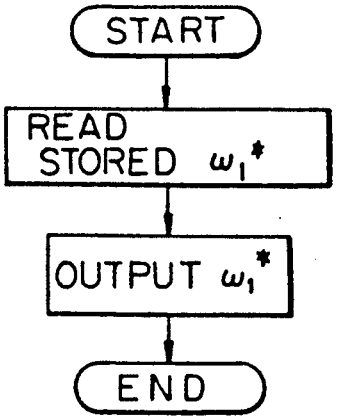

The memory 232 comprises a RAM 2321 in which a series of the take-up rate commands $\omega_1$* and data to be processed by CPU 233 are stored, and a ROM 2322, on which a take-up control program for operating CPU 233 is written. An example of the program is illustrated in FIGS. 9(*a*) and 9(*b*).

The take-up control computer 23, while allowing an interruption, sequentially reads the take-up rate commands $\omega_1$* stored in the RAM 2321 in synchronization with the zero phase pulse output by the encoder RE. The read $\omega_1$* is transmitted to the take-up motor driving circuit 27 and the let-off control computer 24. This operation, however, starts only after several pulses have been output during the initial stage of a loom start. Namely, a warp take-up or let-off operation is not carried out during this period. The reason therefor is as follows:

As shown in FIG. 10(*a*), the weft arrangement on a fabric in the vicinity of the cloth fell becomes nonuniform while the loom is stationary, and when the loom starts as usual, causes a light filling bar in the area close to the cloth fell. This filling bar can be remedied, as shown in FIG. 10(*b*), by suppressing the warp feed for a while so that the wefts picked after the loom starts push the wefts picked before the loom starts toward the take-up side.

The take-up rate commands $\omega_1$* stored in the take-up control computer 23 may be preliminarily transferred to the let-off control computer 24 and stored in the RAM 2421 thereof. In this case, a synchronizing signal, such as the zero phase pulse, is also transferred to the let-off control computer 24.

The let-off control computer 24 corresponds to a combination of the arithmetic circuit 5, the gain compensator 6, and the let-off control circuit 7 shown in FIG. 1.

The interface circuit 241 thereof takes in into the let-off computer 24 the take-up rate command $\omega_1$* from the take-up control computer 23, the detected value T of a warp tension from the tension detector 22 and the target value T* of a warp tension, and the start command St and the stop command Sp from the system control computer 21, and further, outputs a let-off rate command for the let-off motor $M_2$ to a let-off motor driving circuit 28.

Figure 11:
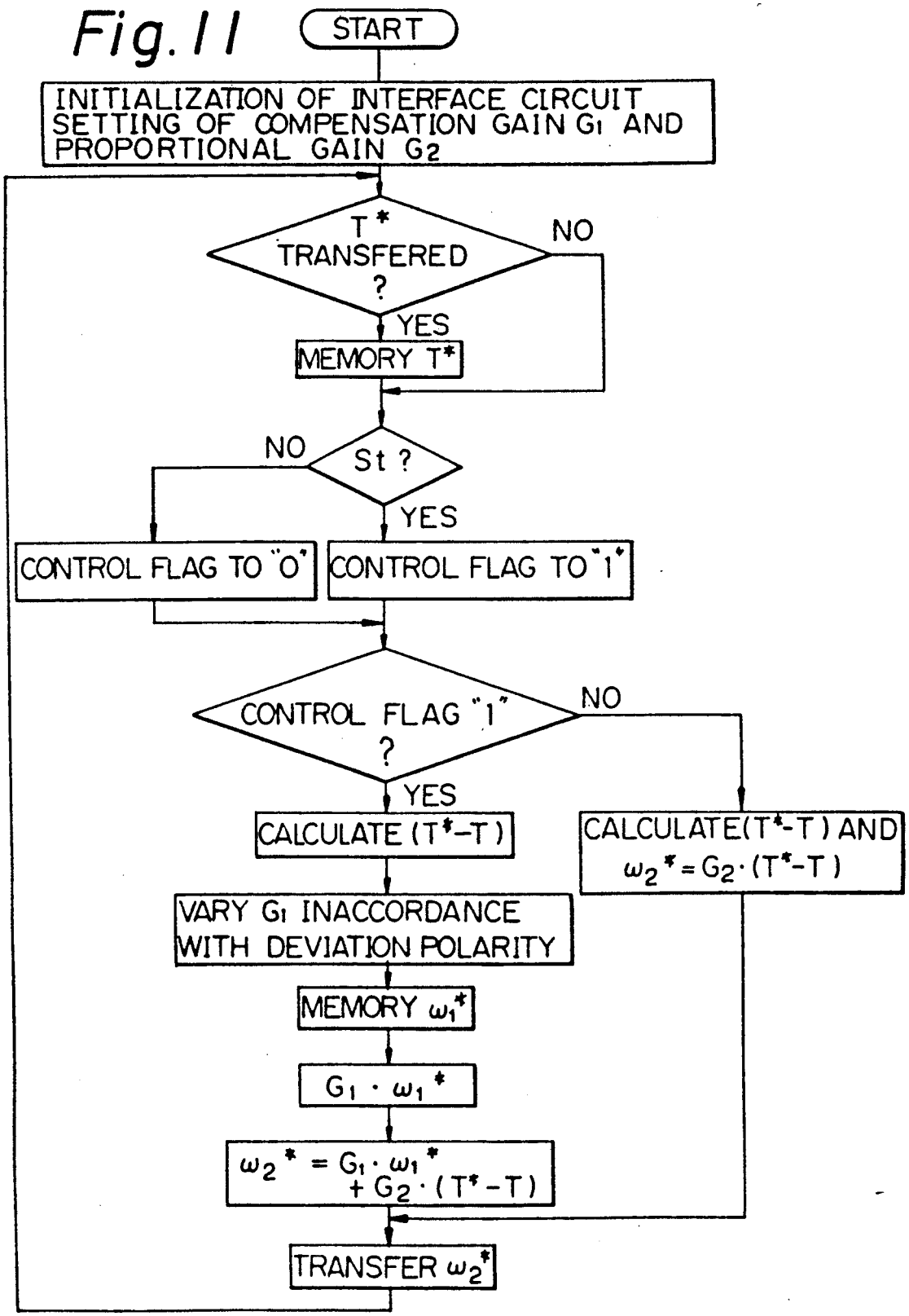
FIG. 11 is a flow chart illustrating the operation of a let-off control computer.

The memory 242 comprises a RAM 2421 in which the target value T* of a warp tension and data to be processed by CPU 243 are stored, and a ROM 2422, in which a let-off control program for operating CPU 243 is written. An example of the program is illustrated in FIG. 11.

The let-off control computer 24, when the start command St is input, carries out a warp tension control in accordance with the tension deviation (T*−T). Also, a let-off rate command $\omega_2$* modified so that the influence by the warp take-up rate $\omega_1$ is compensated is output to a let-off motor driving circuit 28.

To obtain the let-off rate command $\omega_2$*, the take-up rate command $\omega_1$* output by the take-up control computer 23 is multiplied in the let-off control computer 24 with a variable gain $G_1$ preliminarily stored in the RAM 2421, which gain is selected in accordance with the tension deviation (T*−T). The resultant value is added to a basic let-off rate command obtained by the multiplication of the tension deviation (T*−T) and a fixed gain $G_1$, and the final result is output as a modified let-off command $\omega_2$*.

The variable gain $G_1$on RAM 2421 becomes smaller with the passing of time if the tension deviation (T*−T) has a positive value, i.e., when the warp is in a slack state, so that a suitable let-off rate $\omega_2$ smaller than the take-up rate $\omega_1$ is obtained. Conversely, if the tension deviation (T*−T) has a negative value, i.e., when the warp is in a tense state, the variable gain $G_1$ in the RAM 2421 becomes larger with the passing of time, so that a suitable let-off rate $\omega_2$ larger than the take-up rate $\omega_1$ is obtained. According to these operations, the warp feed is always controlled so that the tension deviation (T*−T) becomes zero, i.e., the take-up rate $\omega_1$ and the let-off rate $\omega_2$ of a warp coincide with each other.

Through the take-up and let-off motor driving circuits 27, 28, as described in the first embodiment, the rotational rates of the take-up and let-off motors are controlled so as to coincide with the $\omega_2$*.

The operation of the second embodiment according to the present invention will be described below.

The operator inputs data representing the weaving conditions, such as kinds of weft and warp yarns, a target weft density D*, a rotational rate of a loom N, or a target warp tension T*, through the keyboard KB. For the target weft density D*, more than one value can be input so that various weft density patterns are obtained. Also, for the target value T* of the warp tension, more than one value can be input so that a smooth weaving operation and a favorable fabric quality are obtained, although the target tension is usually set at one level during the weaving operation.

After the completion of the data input from the keyboard KB, an initial step for conducting the weaving operation is commenced, as follows:

In the system control computer 21, a take-up rate command $\omega_f$* is determined by referring to the input data. Also, the modification of the $\omega_f$* is carried out by taking the displacement of the cloth fell position into account. These results and the target value of a warp tension are transmitted to the take-up control computer 23 and the let-off control computer 24. On the other hand, the let-off control computer 24 controls the warp tension to coincide with the target value T* transmitted from the system control computer 21, prior to the commencement of the weaving operation, so that a sudden change of the warp tension does not occur immediately after the loom start. Such a tension change would cause an undesirable displacement of the cloth fell position.

After the above initial step, the operator inputs a start command St through the keyboard KB, which command is transmitted by the system control computer 21 to the take-up control computer 23, the let-off control computer 24, and the loom control computer CM.

The picking and shedding motions of the loom are started under the supervision of the loom control computer CM.

The take-up control computer 23 sequentially reads the take-up rate commands $\omega_1$* stored in the RAM 2321, in synchronization with the zero phase pulses output from the rotary encoder RE as the crankshaft of the loom is rotated, and transmits the same to the take-up motor driving circuit 27 and the let-off computer 24.

The let-off control computer 24 carries out a warp tension control in accordance with the tension deviation (T*−T) between the detected warp tension T issued from the tension detector 22 and the target tension T*. Also, the computer 24 outputs a let-off rate command $\omega_2$* for the let-off motor $M_2$, modified so that the influence by the warp take-up rate $\omega_1$ is compensated. The command $\omega_2$* is transmitted to a let-off motor driving circuit 28.

The weaving operation is smoothly carried out by the repetition of the above sequential operations.

When the operator inputs the stop signal Sp through the keyboard KB, this command is transmitted by the system control computer 21 to the take-up control computer 23, let-off control computer 24, and the loom control computer CM, and thus the loom control computer CM stops the picking and shedding motions of the loom, and the take-up control computer 23 and the let-off control computer 24 output zero warp feed rate commands to stop the take-up and let-off motors.

The effects of the second embodiment are as follows:

A warp take-up speed always optimally controlled to match a warp let-off speed, even when a weaving condition such as the weft density is changed. Further, since the displacement of the cloth fell position due to the change of the weaving condition can be compensated by the present invention, a high quality fabric free from an uneven weft density is obtainable.

Further, since the sequential control operations are conducted by software, the hardware of the system can be simplified.

Also, since the compensation value for the displacement of the cloth fell position may be optionally obtained from an equation or a data table, a precise control for a warp feed rate can be achieved in response to the various weaving conditions. Further, the control constants are easily changed by observing the weft density in the resultant fabric.

Since the influence on the displacement of the cloth fell position due to the change of the respective weaving condition is linearly approximated, the compensation therefor is flexibly and precisely carried out.

Finally, even if the weaving conditions are complicated, such conditions can be easily and precisely set in the control system.

We claim:

1. A system for controlling take-up and let-off rates or warp feed on a loom, having different weaving conditions, by taking the displacement of a cloth fell position into account when weaving conditions of the loom are changed; comprising;

a device for setting the weaving conditions of the loom;

a cloth fell position compensation circuit for issuing a cloth fell compensation signal for compensating a displacement of the cloth fell position caused by a change of at least one of the weaving conditions;

a take-up control circuit for forming a take-up rate control signal for controlling a rotational rate of a take-up motor for driving a take-up roller of the loom with reference to the weaving conditions and the cloth fell position compensation signal and for outputting the take-up control signal;

a tension detector for detecting a warp tension;

an arithmetic circuit for comparing a detected warp tension with a target warp tension and outputting a deviation therebetween;

a gain compensation circuit for outputting a gain compensation signal obtained by multiplication of the take-up rate control signal modified by the cloth fell compensation signal with a gain corresponding to the deviation between the detected warp tension and the target warp tension; and a let-off control circuit for outputting a let-off rate control signal for controlling a rotational rate of a let-off motor for driving a let-off beam, comprising an adder for adding a signal proportional to the deviation between the detected warp tension and the target warp tension to the take-up rate control signal modified by the gain compensation circuit.

2. A control system as defined by claim 1, wherein the cloth fell position compensation circuit includes means for controlling at least either one of a magnitude of the cloth fell compensation signal or a time for which the signal is output by taking the displacement of the cloth fell position into account when at least one of the weaving conditions has been changed.

3. A control system as defined in claim 1, wherein the cloth fell compensation signal is formed by the cloth fell position compensation circuit which includes means for referring to a differential value of a basic warp feed rate control signal corresponding to a command signal for changing a target weft density in order to form the cloth fell compensation signal.

4. A control system as defined in claim 1, wherein the cloth fell compensation signal is determined by the cloth fell position compensation circuit which includes means so that an integrated value thereof, during a time in which the signal is output, is equal to the displacement of the cloth fell position.

5. A control system as defined in claim 1, wherein the cloth fell position compensation circuit processes data associated with the change of the weaving conditions, in a real time manner.

6. A control system as defined in claim 1, wherein the cloth fell position compensation circuit has equation means for modifying the basic warp feed rate command and forms the compensation signal.

7. A control system as defined in claim 1, wherein at least one weaving condition selected from a target weft density, a thickness of a weft yarn, and a weaving structure is set in the weaving condition setting device, the cloth fell compensation signal being formed by the cloth fell position compensation circuit which includes means for forming the cloth fell compensation signal in accordance with variations of the weaving conditions.

8. A control system as defined in claim 7, wherein the weaving structure is one of a plain weave and a twill weave.

9. A system for controlling take-up and let-off rates of warp feed on a loom, having different weaving conditions, by taking the displacement of a cloth fell position into account when weaving conditions have been changed; comprising;

a device for setting the weaving conditions of the loom;

a cloth fell position compensation circuit for outputting a cloth fell compensation signal for compensating a displacement of the cloth fell position caused by a change of the weaving conditions;

a take-up control circuit for forming a take-up rate control signal for controlling a rotational rate of a take-up motor for driving a take-up roller of the loom with reference to the weaving conditions and the cloth fell compensation signal and for outputting the take-up rate control signal; and a let-off control circuit for forming a let-off rate control signal for controlling a rotational rate of a let-off motor for driving a let-off beam in accordance with the take-up rate control signal by taking the displacement of the cloth fell position into account and for outputting the let-off rate control signal.

* * * * *

UNITED STATES PATENT AND TRADEMARK OFFICE

CERTIFICATE OF CORRECTION

PATENT NO. : 5,024,253

DATED : June 18, 1991

INVENTOR(S) : Susumu Kawabata, et al.

It is certified that error appears in the above-identified patent and that said Letters Patent is hereby corrected as shown below:

On the title page:
The Assignee information is incorrect, should be,
--Kabushiki Kaisha Toyota Chuo Kenkyusho, Aichi; Kabushiki Kaisha Toyoda Jidoshokki Seisakusho, Kariya, both of Japan--.

Signed and Sealed this

Fifth Day of January, 1993

*Attest:*

DOUGLAS B. COMER

*Attesting Officer*

*Acting Commissioner of Patents and Trademarks*